US011530848B2

(12) United States Patent
Park et al.

(10) Patent No.: US 11,530,848 B2
(45) Date of Patent: Dec. 20, 2022

(54) AIR CONDITIONER

(71) Applicant: LG Electronics Inc., Seoul (KR)

(72) Inventors: Jungmin Park, Seoul (KR); Eunjun Cho, Seoul (KR)

(73) Assignee: LG Electronics Inc., Seoul (KR)

( * ) Notice: Subject to any disclaimer, the term of this patent is extended or adjusted under 35 U.S.C. 154(b) by 55 days.

(21) Appl. No.: 17/067,080

(22) Filed: Oct. 9, 2020

(65) Prior Publication Data

US 2021/0302072 A1 Sep. 30, 2021

(30) Foreign Application Priority Data

Mar. 30, 2020 (KR) ..... 10-2020-0038066

(51) Int. Cl.

| | |
|---|---|
| ***F25B 13/00*** | (2006.01) |
| ***F25B 41/20*** | (2021.01) |
| ***F25B 49/02*** | (2006.01) |

(52) U.S. Cl.

CPC ..... *F25B 13/00* (2013.01); *F25B 41/20* (2021.01); *F25B 49/02* (2013.01); *F25B 2313/0315* (2013.01); *F25B 2600/2515* (2013.01)

(58) Field of Classification Search

CPC ..... F25B 13/00; F25B 41/20; F25B 49/02; F25B 2313/0315; F25B 2600/2515

See application file for complete search history.

(56) References Cited

U.S. PATENT DOCUMENTS

| | | | | |
|---|---|---|---|---|
| 2009/0044550 | A1* | 2/2009 | Nishimura | F25B 49/005 62/149 |
| 2015/0338121 | A1 | 11/2015 | Yamashita | |
| 2017/0089614 | A1* | 3/2017 | Miyagi | F25B 5/02 |

FOREIGN PATENT DOCUMENTS

| | | | | |
|---|---|---|---|---|
| EP | 2944897 | | 11/2015 | |
| EP | 3040648 | | 7/2016 | |
| EP | 3719414 | | 10/2020 | |
| KR | 20180104416 | A * | 9/2018 | F25B 41/04 |
| KR | 1020180104416 | | 9/2018 | |

OTHER PUBLICATIONS

Jun, Air Conditioner, 2018, Full Document (Year: 2018).*

EP Extended European Search Report in European Appln. No. 20205437.5, dated May 3, 2021, 10 pages.

* cited by examiner

*Primary Examiner* — Nael N Babaa

(74) *Attorney, Agent, or Firm* — Fish & Richardson P.C.

(57) ABSTRACT

Provided is an air conditioner including a connection pipe connected to a refrigerant pipe disposed inside an outdoor heat exchanger that operates as a condenser during a cooling operation and as an evaporator during a heating operation, a header connected to the connection pipe, wherein a refrigerant separated from a two-phase refrigerant flowing through the refrigerant pipe flows through the header, a bypass pipe connected to the header to guide a flow of the refrigerant to a compressor, a flow rate control valve installed at the bypass pipe to control a flow velocity of the refrigerant, a subcooler configured to superheat the refrigerant flowing through the bypass pipe, and a controller configured to control an opening degree of the flow rate control valve.

17 Claims, 6 Drawing Sheets

AIR CONDITIONER

CROSS-REFERENCE TO RELATED APPLICATION

This application claims the benefit of Korean Patent Application No. 10-2020-0038066, filed on Mar. 30, 2020, the disclosure of which is incorporated herein in its entirety by reference.

BACKGROUND

1. Field

The present disclosure relates to an air conditioner that superheats a refrigerant, separated by a flow pattern, inside an evaporator, thereby preventing damage to a compressor and improving reliability of the air conditioner.

2. Description of the Related Art

In general, an air conditioner is a device for cooling or heating indoor air using a refrigeration cycle device that is composed of a compressor, an outdoor heat exchanger, an expansion device, and an indoor heat exchanger.

In the case of cooling indoor air, the outdoor heat exchanger functions as a condenser, the indoor heat exchanger functions as an evaporator, and a refrigerant is circulated in the order of the compressor, the outdoor heat exchanger, the expansion device, the indoor heat exchanger, and the compressor.

In the case of heating indoor air, the outdoor heat exchanger functions as an evaporator, the indoor heat exchanger functions as a condenser, and a refrigerant is circulated in the order of the compressor, the indoor heat exchanger, the expansion mechanism, the outdoor heat exchanger, and the compressor.

Korea Patent Application Publication No. 10-2018-0104416 relates to a technique for improving operation performance of an outdoor heat exchanger by allowing a refrigerant to flow smoothly at a low outside temperature. However, the aforementioned related patent document does not disclose a technique of separating a refrigerant by a flow pattern inside an evaporator and controlling a degree of superheat of the separated refrigerant.

SUMMARY

An aspect provides a technique relating to an air conditioner that superheats a refrigerant, separated by a flow pattern, inside an evaporator to prevent damage to a compressor and improve reliability. It will be appreciated by persons skilled in the art that the objects that could be achieved with the present disclosure are not limited to what has been particularly described hereinabove and the above and other objects that the present disclosure could achieve will be more clearly understood from the following detailed description.

According to an aspect, there is provided an air conditioner including a connection pipe connected to a refrigerant pipe disposed inside an outdoor heat exchanger that operates as a condenser during a cooling operation and as an evaporator during a heating operation, a header connected to the connection pipe, wherein a refrigerant separated from a two-phase refrigerant flowing through the refrigerant pipe flows through the header, a bypass pipe connected to the header to guide a flow of the refrigerant to a compressor, a flow rate control valve installed at the bypass pipe to control a flow rate of the refrigerant, a subcooler configured to superheat the refrigerant flowing through the bypass pipe, and a controller configured to control an opening degree of the flow rate control valve.

The controller may be configured to control the opening degree of the flow rate control valve based on a comparison between a refrigerant flow velocity of the two-phase refrigerant flowing through the refrigerant pipe and a reference flow velocity.

The refrigerant flow velocity may be determined based on at least one of: a frequency of the compressor, a number of paths of an outdoor unit, and an outside temperature.

The reference flow velocity may be a flow velocity at a time when the two-phase refrigerant flowing through the refrigerant pipe inside the outdoor heat exchanger flows in the form of an annular flow.

The air conditioner may further include a first temperature sensor configured to measure a temperature of a refrigerant introduced into the subcooler, and a second temperature sensor configured to measure a temperature of a refrigerant discharged from the subcooler.

The controller may be configured to control the opening degree of the flow rate control valve based on information obtained by the first temperature sensor and the second temperature sensor.

The controller may be configured to, when a difference between the temperature measured by the first temperature sensor and the temperature measured by the second temperature sensor is equal to or greater than a reference value, increase the opening degree of the flow rate control valve, and, when the difference between the temperature measured by the first temperature sensor and the temperature measured by the second temperature sensor is smaller than the reference value, decrease the opening degree of the flow rate control valve.

The subcooler may be configured to exchange heat between a refrigerant flowing from an indoor heat exchanger to the outdoor heat exchanger and a refrigerant flowing through the bypass pipe.

A dryness at a portion where the refrigerant pipe and the connection pipe are connected to each other corresponds to a predetermined range.

Specific details of other embodiments are included in the detailed description and drawings.

BRIEF DESCRIPTION OF THE DRAWINGS

The above and other aspects, features, and advantages of certain embodiments will be more apparent from the following detailed description taken in conjunction with the accompanying drawings, in which.

DETAILED DESCRIPTION

Figure 1:
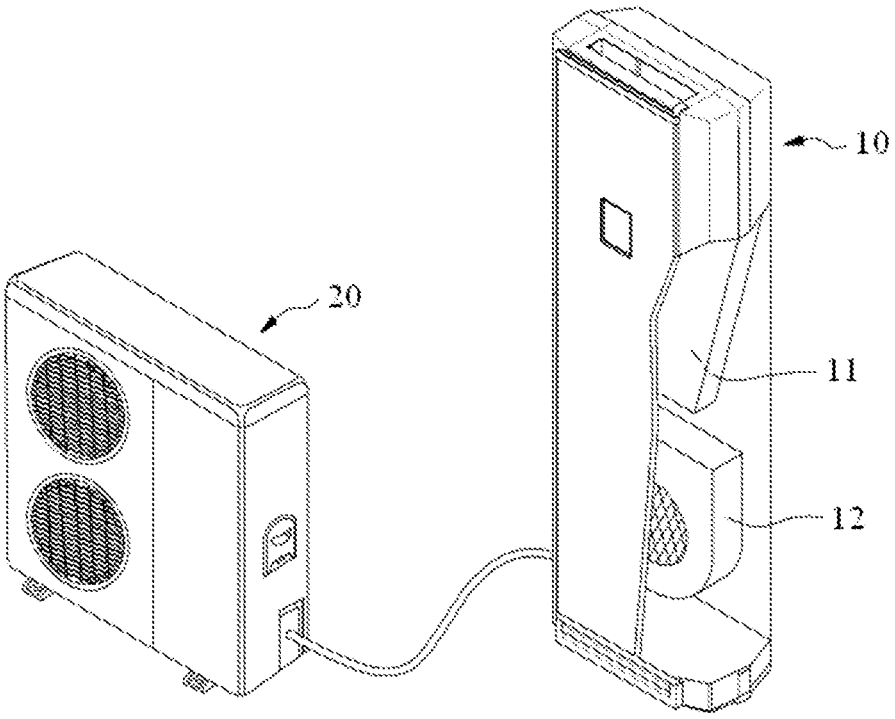
FIG. 1 is a diagram illustrating an air conditioner including an indoor unit and an outdoor unit according to an embodiment.

Hereinafter, embodiments of the present disclosure will be described in detail with reference to the accompanying drawings.

Hereinafter, exemplary embodiments disclosed herein will be described in detail with reference to the accompanying drawings, but the same or similar elements are assigned the same reference numbers regardless of the reference numerals, and overlapping descriptions thereof will be omitted. The suffixes "module" and "part" for components used in the following description are given or mixed only considering the ease of writing the specification, and do not have meanings or roles that are distinguished from each other. In addition, in the description of the embodiments disclosed herein, when it is determined that detailed descriptions of related known technologies may obscure the gist of the embodiments disclosed herein, detailed descriptions thereof will be omitted. In addition, the accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

Terms including ordinal numbers such as first and second may be used to describe various components, but the components are not limited by the terms. The terms are used only for the purpose of distinguishing one component from other components.

When an element is said to be "connected" or "connected" to another component, it is understood that other components may be directly connected to or connected to the other component, but there may be other components in between. On the other hand, when a component is said to be "directly connected" or "directly connected" to another component, it should be understood that no other component exists in the middle.

Singular expressions include plural expressions unless the context clearly indicates otherwise.

In this application, terms such as "comprises" or "have" are intended to indicate that a feature, number, step, operation, component, part, or combination thereof described in the specification exists, and that one or more other features are present. It should be understood that the existence or addition possibilities of fields or numbers, steps, operations, components, parts or combinations thereof are not excluded in advance.

In describing the embodiments, descriptions of technical contents well known in the technical field to which the present disclosure pertains and which are not directly related to the present disclosure will be omitted. This is to more clearly and without obscuring the subject matter of the present disclosure by omitting unnecessary description.

For the same reason, some components in the accompanying drawings are exaggerated, omitted, or schematically illustrated. Also, the size of each component does not entirely reflect the actual size. The same reference numbers are assigned to the same or corresponding elements in each drawing.

Advantages and features of the present disclosure, and a method of achieving them will be apparent with reference to embodiments described below in detail together with the accompanying drawings. However, the present disclosure is not limited to the embodiments disclosed below, and may be implemented in various different forms, and only the embodiments allow the disclosure of the present disclosure to be complete, and common knowledge in the technical field to which the present disclosure pertains. It is provided to fully inform the holder of the scope of the disclosure, and the disclosure is only defined by the scope of the claims. The same reference numerals refer to the same components throughout the specification.

FIG. 1 is a diagram illustrating an air conditioner including an indoor unit and an outdoor unit according to an embodiment.

Referring to FIG. 1, the air conditioner may include an indoor unit 10 and an outdoor unit 20. In the air conditioner, the indoor unit 10 is depicted as a standing type, but may be a wall-mounted type or a ceiling-mounted type. The indoor unit 10 is not limited to a standing type, a wall-mounted type, or a ceiling type, and may be installed indoors in any of various shapes.

The outdoor unit 20 may be connected to the indoor unit 10 and transfer refrigerant necessary for air conditioning in the indoor unit 10 to the indoor unit 10. The indoor unit 10 may exchange heat between the transferred refrigerant and air, and discharge the heat-exchanged air into an indoor space.

The indoor unit 10 and the outdoor unit 20 may be connected through a refrigerant pipe so that refrigerant circulates through the indoor unit 10 and the outdoor unit 20 via the refrigerant pipe. Hot or cold air may be discharged into the indoor space from the indoor unit 10 that performs a heating operation or a cooling operation according to circulation of the refrigerant. At this point, at least one indoor unit 10 may be connected to the outdoor unit 20, and FIG. 1 shows connection between one outdoor unit 20 and one indoor unit 10 as an example.

The indoor unit 10 and the outdoor unit 20 may be connected via a cable for communication, and hence, control commands may be transmitted or received according to a predetermined communication method.

The indoor unit 10 may include an inlet for suctioning indoor air, and an outlet for discharging heat-exchanged air from an inside. The indoor unit 10 may include an air direction control apparatus provided in the outlet. The air direction control apparatus may open and close the outlet or may control a direction of air discharged from the outlet. In addition, the indoor unit 10 may control a volume of air discharged from the outlet. The indoor unit 10 may include a vane installed at the inlet or the outlet. The vane may open and close at least one of the inlet and the outlet, and may guide an air flow direction.

The indoor unit 10 may further include a display for displaying an operating state and setting information of the indoor unit 10, and an input part for inputting setting data. When the user inputs an operation command for the air conditioner through the input part, the outdoor unit 20 may be operated for a cooling operation or a heating operation in response to the input operation command. At this point, the user may input an operation command for the air conditioner manually or through communication.

When the air conditioner is in a cooling operation, the outdoor heat exchanger included in the outdoor unit may function as a condenser in which a refrigerant flowing to the outdoor heat exchanger is condensed by outdoor air. Also, when the air conditioner is in a heating operation, the outdoor heat exchanger may function as an evaporator in which liquid-phase refrigerant flowing into the outdoor heat exchanger can be evaporated by outdoor air.

The indoor unit may include an indoor heat exchanger 11 for performing heat exchange between indoor air and refrigerant, and an indoor blower 12 for blowing the indoor air to the indoor heat exchanger 11. When the air conditioner is in a cooling operation, the indoor heat exchanger included in the indoor unit may function as an evaporator in which refrigerant flowing into the indoor heat exchanger is evaporated by indoor air. In addition, when the air conditioner is in a heating operation, the indoor heat exchanger included in the indoor unit may function as a condenser in which a refrigerant flowing to the indoor heat exchanger is condensed by indoor air.

Figure 2:
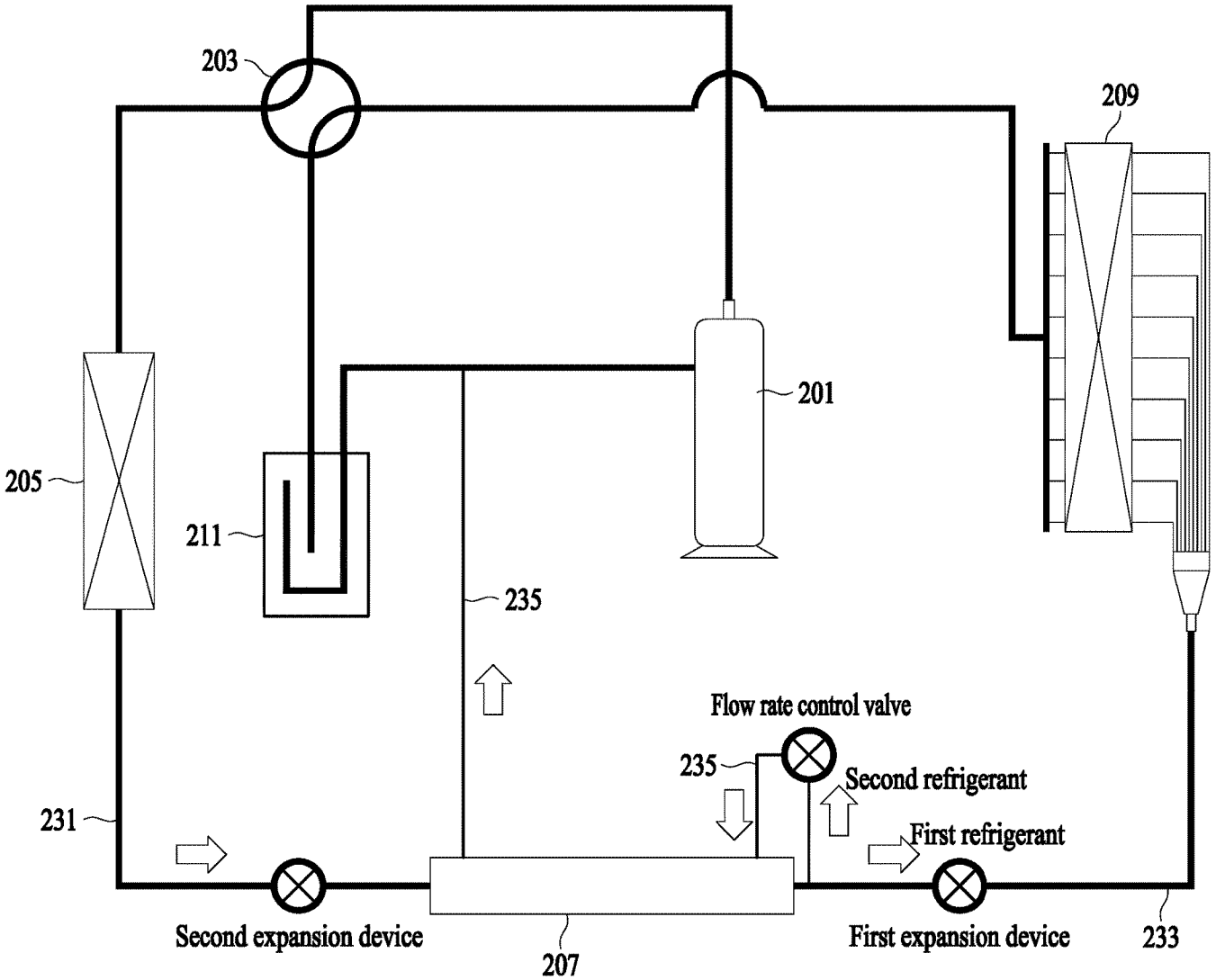
FIG. 2 is a diagram showing a system of an air conditioner according to an embodiment.

FIG. 2 is a diagram showing a system of an air conditioner according to an embodiment.

Referring to FIG. 2, the air conditioner may include at least one of: a compressor 201, a four way valve 203, a condenser 205, a first expansion device, an second expansion device, a flow rate control valve, a subcooler 207, an evaporator 209, and an accumulator 211.

The compressor 201 may compress a refrigerant. The condenser 205 may condense the refrigerant passing through the compressor 201. In addition, the evaporator may evaporate the refrigerant passing through the first expansion device and the second expansion device. In addition, the first expansion device and the second expansion device may expand the refrigerant passing through the condenser 205. The first expansion device may be installed at a refrigerant pipe between the subcooler 207 and the evaporator 209, and the second expansion device may be installed at a refrigerant pipe between the subcooler 207 and the condenser 205. At this point, an opening degree of each of the first expansion device and the second expansion device may be adjusted to or not to expand the refrigerant flowing therein. For example, when the air conditioner is in a heating operation, the second expansion device may be fully opened so that the refrigerant passing through the condenser is not expanded, and an opening degree of the first expansion device may be adjusted to partially open the first expansion device, so that the refrigerant passing through the condenser is expanded.

When the air conditioner is in the cooling operation, the outdoor heat exchanger may function as a condenser, and the indoor heat exchanger may function as an evaporator. In the cooling operation of the air conditioner, a refrigerant may circulate in the order of the compressor, the condenser, the first expansion device, the second expansion device, the evaporator, the accumulator and the compressor.

When the air conditioner is in a heating operation, the outdoor heat exchanger may function as an evaporator, and the indoor heat exchanger can function as a condenser. In the heating operation of the air conditioner, a refrigerant may circulate in the order of the compressor, the condenser, the first expansion device, the second expansion device, the evaporator, the accumulator and the compressor.

As such, the air conditioner may be an air conditioner capable of both the cooling operation and the heating operation. Hereinafter, the case where the air conditioner is operated for the heating operation will be described. Yet, the scope of the present disclosure is not limited thereto and may also include the case where the air conditioner is operated for the cooling operation.

When the air conditioner is in the heating operation, the indoor unit may include a condenser 205 which corresponds to an indoor heat exchanger, and the outdoor unit may include an evaporator 209 which corresponds to an outdoor heat exchanger. In addition, the outdoor unit may include at least one of a compressor 201, a four way valve 203, a subcooler 207, and an accumulator 211.

The four way valve 203 may allow a refrigerant discharged from the compressor 201 to flow either to the outdoor heat exchanger or to the indoor heat exchanger. Further, the accumulator 211 may separate a gas refrigerant from a two-phase refrigerant that includes the gas refrigerant and a liquid refrigerant. The liquid refrigerant separated by the accumulator 211 may be received in a lower side of the accumulator 211, and the gas refrigerant may be received above the separated liquid refrigerant. The gas refrigerant separated by the accumulator 211 may flow to the compressor 201, and the liquid refrigerant separated by the accumulator 211 may remain in the accumulator 211.

When the air conditioner is in the heating operation, a refrigerant may pass through the compressor 201 and the indoor heat exchanger 205, expand in the first expansion device, and be then heat exchanged with outdoor air in the outdoor heat exchanger 209. At this point, the second expansion device may be fully opened, and an opening degree of the first expansion device may be adjusted to expand the refrigerant.

Specifically, when the air conditioner is in the heating operation, a refrigerant discharged from the compressor may flow to the indoor heat exchanger 205 by the four way valve 203. A refrigerant condensed in the indoor heat exchanger 205 may be subcooled by the subcooler 207 and then flow to the outdoor heat exchanger 209.

The refrigerant condensed in the indoor heat exchanger 205 may flow through the refrigerant pipe 231. The refrigerant may flow to the subcooler 207 through the refrigerant pipe 231. In addition, the refrigerant passing through the subcooler 207 may flow to the evaporator through the refrigerant pipe 233. Here, the refrigerant flowing through the refrigerant pipe 231 and the refrigerant pipe 233 will be referred to as a first refrigerant.

In order to inject refrigerant into the compressor 201, a portion of the first refrigerant may be branched by the bypass pipe 235. Hereinafter, the portion branched from the first refrigerant will be referred to as a second refrigerant. That is, the second refrigerant may be a refrigerant flowing through the bypass pipe 235.

The flow rate control valve may be installed at the bypass pipe 235, and the amount of the second refrigerant flowing through the bypass pipe 235 may be determined by adjusting the opening degree of the flow rate control valve. When the flow rate control valve is opened, the second refrigerant may flow to the subcooler 207 through the bypass pipe 235 and then may be discharged from the subcooler 207 to flow to the compressor. At this point, the second refrigerant discharged from the subcooler 207 may be injected into the compressor 201.

The first refrigerant flowing through the refrigerant pipe 231 and the refrigerant pipe 233 may flow through a plurality of inner tubes inside the subcooler 207, and the second refrigerant may flow through an outer tube. At this point, the plurality of inner tubes may be disposed in an inner space of the subcooler 207, and the first refrigerant flowing through the plurality of inner tubes may be heat exchanged with the second refrigerant flowing through the outer tube. Specifically, the second refrigerant may be expanded by the flow rate control valve to have a lower temperature and a lower pressure compared to the first refrigerant, and the second refrigerant of the lower temperature and the lower pressure may, while flowing through the outer tube, exchange heat with the first refrigerant flowing through the inner tube. At this point, the first refrigerant may be subcooled, and the second refrigerant may be superheated. At this point, the subcooled first refrigerant may flow to the evaporator 209 through the refrigerant pipe 233. The evaporator 209 may evaporate a liquid refrigerant into a gas refrigerant through heat exchange with outdoor air.

In some examples, the subcooler 207 can include a heat exchanger or a refrigerant passage or pipe configured to exchange heat with the refrigerant that has passed through the refrigerant pipe 231. In some examples, the subcooler 207 can be a portion of a refrigerant pipe that carries a liquid-phase refrigerant, a gas-phase refrigerant, or both.

Figure 3:
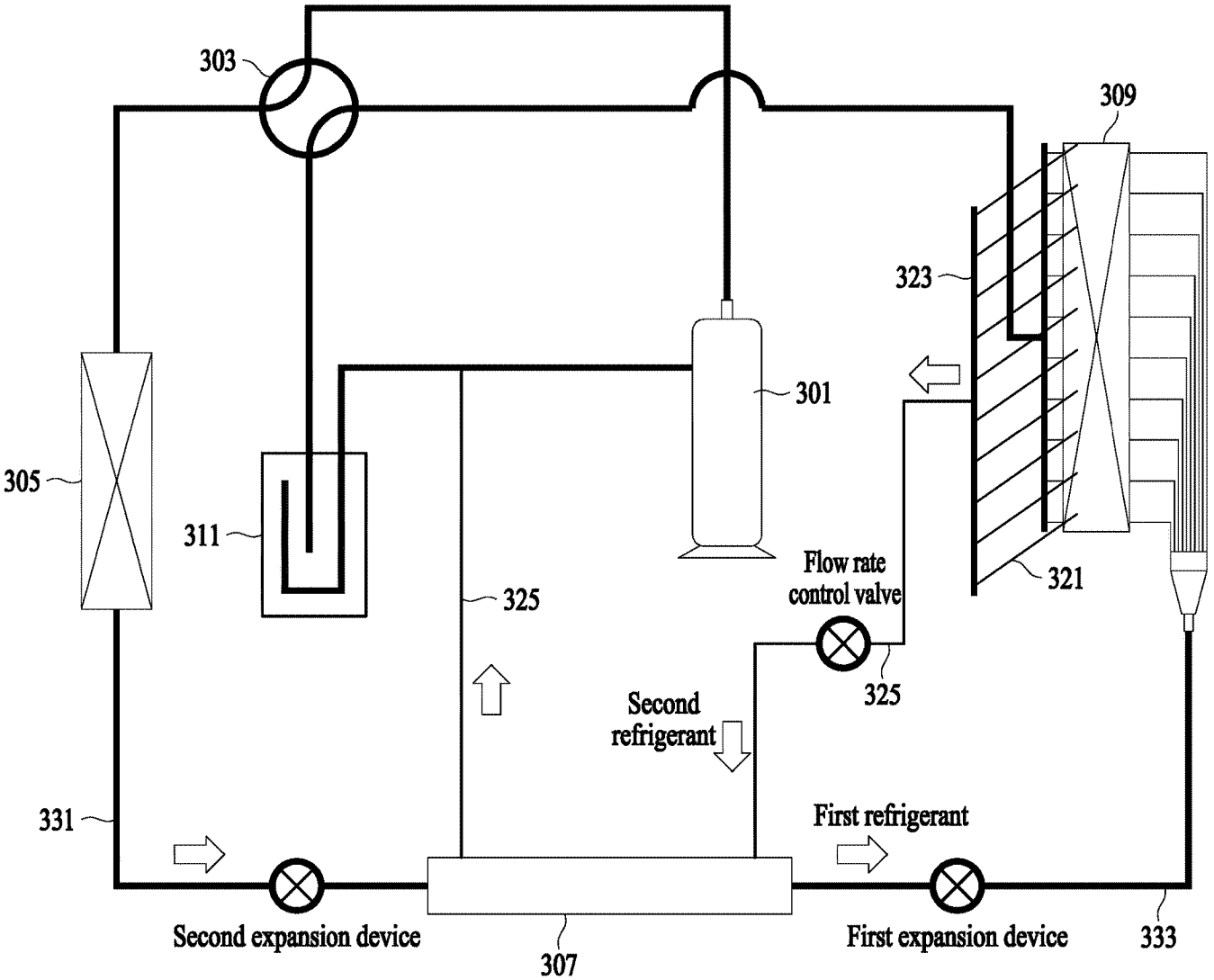
FIG. 3 is a diagram illustrating a system of an air conditioner according to another embodiment.

FIG. 3 is a diagram illustrating a system of an air conditioner according to another embodiment.

Referring to FIG. 3, the air conditioner may include at least one of a compressor 301, a four way valve 303, a condenser 305, a first expansion device, a second expansion device, a flow rate control valve, a subcooler 307, an evaporator 309, and an accumulator 311.

The compressor 301 may compress a refrigerant. The condenser 205 may condense the refrigerant passing through the compressor 201. In addition, the evaporator may evaporate the refrigerant passing through the first expansion device and the second expansion device. In addition, the first expansion device and the second expansion device may expand the refrigerant passing through the condenser 205. Here, the first expansion device may be installed at a refrigerant pipe between the subcooler 307 and the evaporator 309, and the second expansion device may be installed at a refrigerant pipe between the subcooler 307 and the condenser 305. At this point, an opening degree of each of the first expansion device and the second expansion device may be adjusted to or not to expand the refrigerant flowing through the refrigerant pipes 331 and 333. For example, when the air conditioner is in a heating operation, the second expansion device may be fully opened so that the refrigerant passing through the condenser is not expanded, and an opening degree of the first expansion device may be adjusted to partially open the first expansion device, so that the refrigerant passing through the condenser is expanded.

When the air conditioner is in the cooling operation, the outdoor heat exchanger may function as a condenser, and the indoor heat exchanger may function as an evaporator. In the cooling operation of the air conditioner, a refrigerant may circulate in the order of the compressor, the condenser, the first expansion device, the second expansion device, the evaporator, the accumulator and the compressor.

When the air conditioner is in a heating operation, the outdoor heat exchanger may function as an evaporator, and the indoor heat exchanger may function as a condenser. In the heating operation of the air conditioner, a refrigerant may circulate in the order of the compressor, the condenser, the first expansion device, the second expansion device, the evaporator, the accumulator and the compressor.

As such, the air conditioner may be an air conditioner capable of both the cooling operation and the heating operation. Hereinafter, the case where the air conditioner is operated for the heating operation will be described. Yet, the scope of the present disclosure is not limited thereto and may also include the case where the air conditioner is operated for the cooling operation.

When the air conditioner is in the heating operation, the indoor unit may include the condenser 305 which corresponds to an indoor heat exchanger, and the outdoor unit may include the evaporator 309 which corresponds to an outdoor heat exchanger. In addition, the outdoor unit may include at least one of the compressor 301, the four way valve 303, the subcooler 307, and the accumulator 311.

The four way valve 303 may guide a refrigerant discharged from the compressor 301 to flow either to an outdoor heat exchanger or to an indoor heat exchanger. Further, the accumulator 311 may separate a gas refrigerant from a two-phase refrigerant that includes a liquid refrigerant and the gas refrigerant. The liquid refrigerant separated from the accumulator 311 may be received in a lower side of the accumulator 311, and the gas refrigerant may be received above the separated liquid refrigerant. The gas refrigerant separated in the accumulator 311 may flow to the compressor 301, and the liquid refrigerant separated in the accumulator 311 may remain in the accumulator 311.

When the air conditioner is in the heating operation, a refrigerant may expand in the first expansion device after passing through the compressor 301 and the indoor heat exchanger 305, and then may be heat exchanged with outdoor air in the outdoor heat exchanger 309. At this point, the second expansion device may be fully opened, and an opening degree of the first expansion device may be adjusted to expand the refrigerant.

Specifically, when the air conditioner is in the heating operation, a refrigerant discharged from the compressor may flow to the indoor heat exchanger 305 by the four way valve 303. The refrigerant condensed in the indoor heat exchanger 305 may be subcooled in the subcooler 307 and then flow to the outdoor heat exchanger 309.

The refrigerant condensed in the indoor heat exchanger 305 may flow through the refrigerant pipe 331. The refrigerant may flow to the subcooler 307 through the refrigerant pipe 331. In addition, the refrigerant passing through the subcooler 307 may flow to the evaporator through the refrigerant pipe 333. Here, the refrigerant flowing through the refrigerant pipe 331 and the refrigerant pipe 333 will be referred to as a first refrigerant.

The air conditioner may include a gas-liquid separator. Here, the gas-liquid separator may separate a gas refrigerant in the evaporator 309 and guide the gas refrigerant to the compressor 301. Specifically, the gas-liquid separator may include at least one of: a connection pipe 321, a header 323, a flow rate control valve, and a bypass pipe 325. At this point, a refrigerant separated by the gas-liquid separator to flow through the bypass pipe 325 will be referred to as a second refrigerant.

The connection pipe 321 may be connected to a refrigerant pipe inside the outdoor heat exchanger that operates as an evaporator during a heating operation. The connection pipe 321 may separate a refrigerant from the two-phase refrigerant flowing through the refrigerant pipe inside the outdoor heat exchanger. A plurality of connection pipes 321 may be connected to the header 323, and a refrigerant separated through the plurality of connection pipes 321 may flow through the header 323. The header 323 may be connected to the bypass pipe 325 that guides a flow of the refrigerant to the compressor. For details of the connection pipe 321 and the header 323, FIG. 5 can be referred to. The flow rate control valve may be installed at the bypass pipe 325 to control a flow rate of the refrigerant flowing through the bypass pipe 325. For example, the flow rate control valve may include an electromagnetic expansion valve or a solenoid valve.

The air conditioner may include a subcooler 307, and heat exchange between the first refrigerant and the second refrigerant flowing through the bypass pipe 325 may occur in the sub cooler 307. The second refrigerant may flow to the subcooler 307 through the bypass pipe 325, and the second refrigerant and the first refrigerant may be heat exchanged in the subcooler 307. At this point, due to the heat exchange between the refrigerants in the subcooler 307, the first refrigerant may be subcooled and the second refrigerant may be superheated. The first refrigerant may flow through a plurality of inner tubes inside the subcooler 307, and the second refrigerant may flow through an outer tube. At this point, the plurality of inner tubes may be arranged in an inner space of the subcooler 307, and the first refrigerant flowing through the plurality of inner tubes may exchange heat with the second refrigerant flowing through the outer tube. Specifically, the second refrigerant may be expanded by the flow rate control valve to have a lower temperature and lower pressure compared to the first refrigerant, and the second refrigerant of the lower temperature and the lower pressure may, while flowing the outer tube, exchange heat with the first refrigerant flowing through the plurality of inner tubes. The first refrigerant may be subcooled and the second refrigerant may be superheated. At this point, the first refrigerant subcooled may flow to the evaporator 209 through the refrigerant pipe 233, and the second refrigerant superheated may flow to the compressor 301. As the second refrigerant is superheated, a gas refrigerant may account for a greater proportion in refrigerants flowing to the compressor 301 through the bypass pipe 325, and accordingly, stability and reliability of operation of the compressor 301 may be further improved.

The air conditioner may include a first temperature sensor for measuring a temperature of the second refrigerant flowing into the subcooler 307. In addition, the air conditioner may include a second temperature sensor for measuring a temperature of the second refrigerant discharged from the subcooler 307. That is, the first temperature sensor may measure a temperature of the second refrigerant at an inlet of the subcooler 307, through which the second refrigerant is introduced into the subcooler 307, and the second temperature sensor may measure a temperature of the second refrigerant at an outlet of the subcooler 307, through which the second refrigerant is discharged to flow to the compressor 301.

The air conditioner may include a controller for controlling an opening degree of the flow rate control valve. When the flow rate control valve is closed, the refrigerant separated from the two-phase refrigerant flowing through the refrigerant pipe inside the outdoor heat exchanger during a heating operation may not flow to the bypass pipe 325. In addition, when the flow rate control valve is opened, the refrigerant separated from the two-phase refrigerant flowing through the refrigerant pipe inside the outdoor heat exchanger during the heating operation may flow to the bypass pipe 325. During the heating operation, the controller may estimate a flow velocity of the two-phase refrigerant flowing through the refrigerant pipe inside the outdoor heat exchanger based on relevant information and may control the opening degree of the flow rate control valve by comparing the estimated flow velocity with a reference flow velocity.

When the two-phase refrigerant flowing through the refrigerant pipe inside the outdoor heat exchanger 309 during the heating operation flows in the form of an annular flow, the controller may control the flow rate control valve to be opened. When the flow rate control valve is opened before the annular flow occurs, a large amount of liquid refrigerant may flow through the bypass pipe 325 to the compressor 301, thereby damaging the compressor and deteriorating the reliability of the air conditioner. Therefore, in order to improve the reliability of the air conditioner, it is necessary that the second refrigerant flowing to the compressor does not include a liquid refrigerant.

To this end, the controller may control the opening degree of the flow rate control valve based on a comparison between a refrigerant flow velocity and a reference flow velocity, and the controller may also control the opening degree of the flow rate control valve based on information obtained by the first temperature sensor and the second temperature sensor.

Specifically, the controller may estimate a refrigerant flow velocity of a two-phase refrigerant flowing inside the evaporator in consideration of at least one of: a type of the compressor, a frequency of the compressor, the number of paths of the outdoor unit, and an outside temperature. The controller may estimate a refrigerant flow velocity V1 of the two-phase refrigerant flowing inside the evaporator by Equation 1 below.

$$V1=N/P\times((A\times\text{Outside Temperature})+B) \quad \text{Equation 1}$$

Here, N may be determined according to the type of the compressor, P may be determined as a current number of paths of the evaporator compared to 10 paths, and A and B may be statistical values determined according to a current frequency. For example, if a current number of paths of the evaporator is 12, P may be 1.2, and N may be a value predetermined according to the type of the compressor. Also, A and B may be determined by Equation 2 below. Here, A1, A2, B1, and B2 may be statistical values determined by experiments.

$$A=A1*\text{Frequency}+A2$$

$$B=B1*\text{Frequency}+B2 \quad \text{Equation 2}$$

In addition, the reference flow velocity is a flow velocity at a time when two-phase refrigerant flowing through the refrigerant pipe inside the evaporator flows in the form of an annular flow, and a reference flow velocity V2 may be determined by Equation 3 below. Here, C and D may be statistical values determined by experiments.

$$V2=(C*\text{Outside Temperature})+D \quad \text{Equation 3}$$

The controller may control whether to open or close the flow rate control valve, based on a comparison between an estimated refrigerant flow velocity and the reference flow velocity. Specifically, when the estimated refrigerant flow velocity is greater than the reference flow velocity at a predetermined ratio or more with respect to the reference flow velocity, the controller may open the flow rate control valve so that the refrigerant flows from the evaporator to the bypass pipe. Alternatively, when the estimated refrigerant flow velocity is not greater than the reference flow velocity at the predetermined ratio or more, the controller may close the flow rate control valve so that the refrigerant is prevented from flowing into the bypass pipe. At this point, the predetermined ratio, which is a ratio that takes into consideration a margin between the estimated refrigerant flow velocity and the reference flow velocity, may be a value set for reliability. For example, in the case where it is determined that reliability is ensured when the refrigerant flow velocity is 10% greater than the reference flow velocity, the flow rate control valve may be opened if the refrigerant flow velocity is 1.1 times or greater the reference flow velocity, or in the case where it is determined that reliability is ensured when the refrigerant flow velocity is 20% greater than the reference flow velocity, the flow rate control valve may be opened if the refrigerant flow velocity is 1.2 times or greater the reference flow velocity.

When the flow rate control valve is opened by the controller, the second refrigerant separated from the two-phase refrigerant flowing through the refrigerant pipe inside the evaporator may flow through the bypass pipe 325. At this point, the second refrigerant separated from the two-phase refrigerant flowing through the refrigerant pipe inside the evaporator may consist mostly of a gas refrigerant and may also include a small proportion of a liquid refrigerant. At this point, when a portion of the liquid refrigerant in the two-phase refrigerant is introduced into the compressor 301, the compressor 301 may be damaged. For this reason, the second refrigerant may be superheated in order to ensure the reliability of the air conditioner. Specifically, since the second refrigerant and the first refrigerant are heat exchanged in the subcooler 307, a temperature of the second refrigerant discharged from the subcooler 307 may be higher than a temperature of the second refrigerant introduced into the subcooler 307. In addition, since the second refrigerant and the first refrigerant are heat exchanged in the subcooler 307, a temperature of the first refrigerant discharged from the subcooler 307 may be lower than a temperature of the first refrigerant introduced into the subcooler 307.

As the second refrigerant is superheated in the subcooler 307, a portion of the liquid refrigerant included in the second refrigerant may be vaporized, thereby restricting the introduction of the liquid refrigerant into the compressor 301 through the bypass pipe 325 whereas allowing the gas refrigerant to flow into the compressor 301. Therefore, damage to the compressor 301 may be prevented, thereby improving the reliability of the air conditioner.

More specifically, the controller may control the opening degree of the flow rate control valve based on information obtained by the first temperature sensor and the second temperature sensor. The first temperature sensor may measure a temperature of a portion of the subcooler 307, through which the second refrigerant is introduced, and the second temperature sensor may measure a temperature of a portion of the subcooler 307, from which the second refrigerant is discharged. A degree of superheat of the second refrigerant may be estimated based on a difference between the temperature measured by the first temperature sensor and the temperature measured by the second temperature sensor. At this point, when the degree of superheat of the second refrigerant is higher than a reference value, the compressor 301 may be prevented from being damaged, and thus, the controller may increase the opening degree of the flow rate control valve than before. In addition, when the degree of superheat of the second refrigerant is less than the reference value, the compressor 301 is likely to be damaged, and thus, the controller may decrease the opening degree of the flow rate control valve than before. When the opening degree of the flow rate control valve is increased, a flow rate of the second refrigerant may be increased, and when the opening degree of the flow rate control valve is decreased, a flow rate of the second refrigerant may be decreased. Here, the reference value may be a statistical value determined by experiments in order to ensure the reliability of the air conditioner. For example, when the degree of superheat is 10% greater than the reference value, the controller may increase the opening degree of the flow rate control valve by 10% than before, or when the degree of superheat is 20% greater than the reference value, the controller may increase the opening degree of the flow rate control valve by 20% than before. In another example, when the degree of superheat is 10% less than the reference value, the controller may reduce the opening degree of the flow rate control valve by 10% than before, or when the degree of superheat is 20% less than the reference value, the controller may reduce the opening degree of the flow rate control valve by 20% than before. That is, the controller may control the opening degree of the flow rate control valve based on a comparison between the degree of superheat and the reference value.

Figure 4:
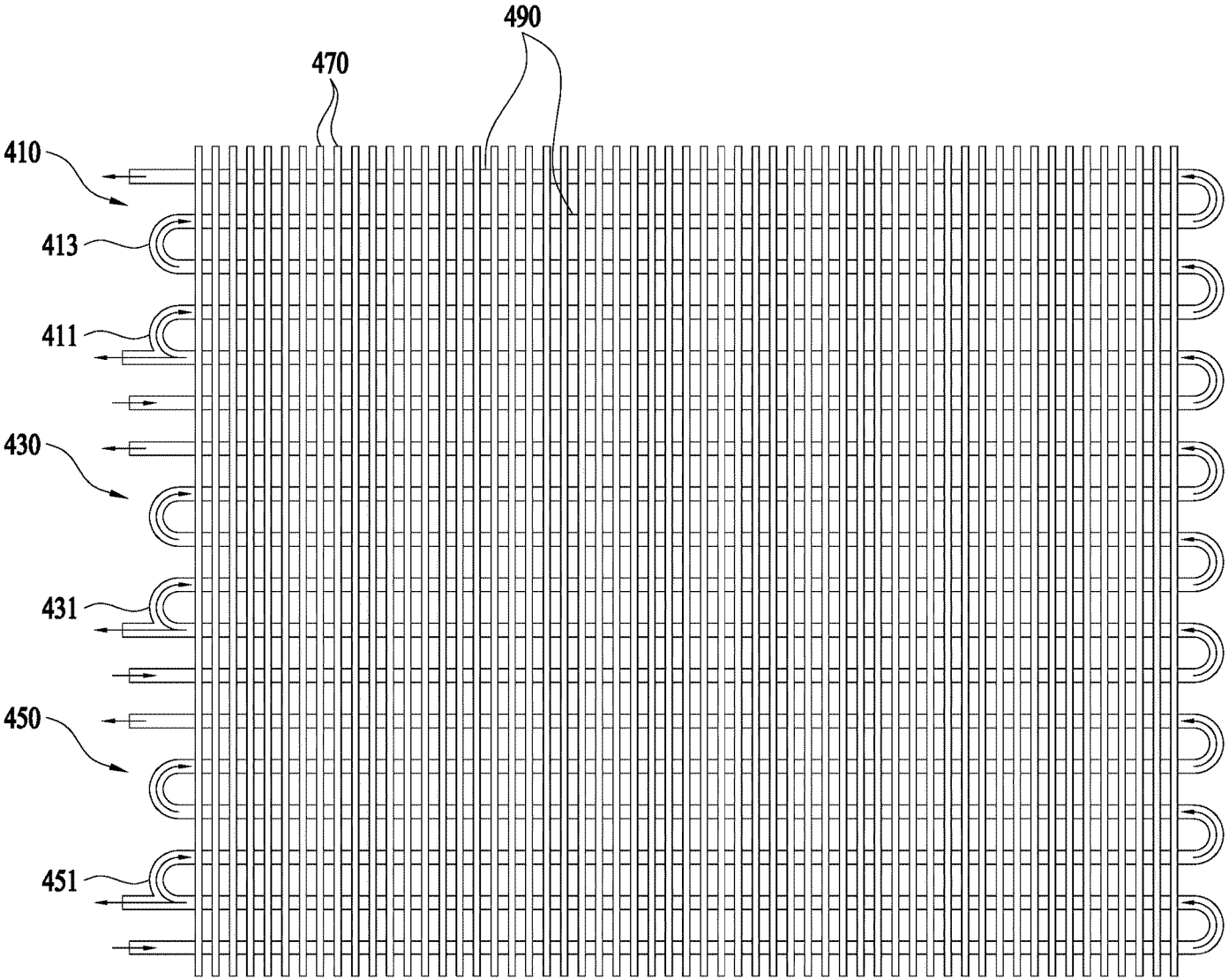
FIG. 4 may be a diagram illustrating a refrigerant pipe of an evaporator according to an embodiment.

FIG. 4 may be a diagram illustrating a refrigerant pipe of an evaporator according to an embodiment.

Referring to FIG. 4, an evaporator which functions as an outdoor heat exchanger during a heating operation may include a plurality of refrigerant flow channels 410, 430, and 450 through which a two-phase refrigerant flows, and a plurality of heat exchange pins 470. A plurality of connection pipes 321 of the gas-liquid separator in FIG. 3 may be connected to a plurality of refrigerant pipe 411, 431, and 451 in FIG. 4, and a refrigerant separated from the plurality of refrigerant pipes 411, 431, and 451 may flow into the bypass pipe 325 through the plurality of connection pipes 321. Here, the plurality of refrigerant flow channels 410, 430, and 450, the plurality of heat exchange pins 470, and a plurality of refrigerant straight-type pipes 490 in FIG. 4 are merely examples, and the scope of the present disclosure is not limited thereto.

The plurality of refrigerant flow channels 410, 430, and 450 may pass through the plurality of heat exchange pins 470. The plurality of heat exchange pins 470 may have through holes respectively formed therein, and the plurality of refrigerant flow channels 410, 430, and 450 may pass through the respective through holes. In a state in which the plurality of refrigerant flow channels 410, 430, and 450 passes through the respective through holes, outer circumferential surfaces of the plurality of refrigerant flow channels 410, 430, 450 may contact inner circumferential surfaces of the respective through holes.

The plurality of heat exchange pins 470 may contact air, thereby improving heat exchange performance between refrigerants flowing in the plurality of refrigerant flow channels 410, 430, and 450 and air outside the plurality of refrigerant flow channels 410, 430, and 450. The plurality of heat exchange pins 470 each may be formed of a rectangular plate body, for example. The plurality of heat exchange pins 470 each may have one surface disposed parallel to each other.

The plurality of connection pipes 321 of the gas-liquid separator may be installed to correspond to the plurality of refrigerant flow channels, respectively. For example, if there are ten flow channels 410, 430, and 450, the number of the connection pipes 321 may be 10, as shown in FIG. 3. In another example, if there are three refrigerant flow channels 410, 430, and 450, the number of the connection pipes 321 may be 3, as shown in FIG. 4.

At this point, the plurality of connection pipes 321 each may be installed at a position where a dryness of the two-phase refrigerant flowing inside the evaporator corresponds to a predetermined range. Specifically, the plurality of refrigerant pipes 411, 431, and 451 may be installed at positions where a dryness of the two-phase refrigerant flowing inside the evaporator corresponds to the predetermined range, and the plurality of connection pipes may be connected to the plurality of installed refrigerant pipes 411, 431, and 451, respectively. For example, the plurality of refrigerant pipes 411, 431, and 451 may be installed at positions where a dryness of the two-phase refrigerant flowing inside the evaporator corresponds to 0.5 to 0.6, and the plurality of connection pipes may be connected to the plurality of installed refrigerant pipes 411, 431, and 451. In another example, a dryness of the two-phase refrigerant near portions where the plurality of refrigerant pipe 411, 431, and 451 are connected to the plurality of connection pipes may be included in the range of 0.5 to 0.6.

In some examples, the refrigerant pipe includes a coupling portion connected to the connection pipe, and a composition ratio of the two-phase refrigerant at the coupling portion can be maintained within a predetermined range. The composition ratio of the two-phase refrigerant can be a ratio between a gas-phase refrigerant and a liquid-phase refrigerant, and define a dryness of the two-phase refrigerant.

The refrigerant flow channel 410 may include a plurality of refrigerant straight-type pipes 490 and a plurality of refrigerant pipes 411 and 413. The plurality of refrigerant straight-type pipes 490 each may be formed straight in a longitudinal direction. The plurality of refrigerant straight-type pipes 490 each may be arranged in parallel to one another. The plurality of refrigerant straight-type pipes 490 may pass through the plurality of heat exchange pins 470. The plurality of heat exchange pins 470 may have through holes respectively formed therein, and the plurality of refrigerant straight-type pipes 490 may pass through the respective through holes. In a state in which the plurality of refrigerant straight-type pipes 490 passes through the respective through holes, outer circumferential surfaces of the plurality of refrigerant straight-type pipes 490 may contact inner circumferential surfaces of the respective through holes. The refrigerant pipe 413 included in the refrigerant flow channel 410 may be a U-shaped refrigerant pipe, and the refrigerant pipe 411 included in the refrigerant flow channel 410 may be an h-shaped refrigerant pipe. The U-shaped refrigerant pipe 413 may connect refrigerant straight-type pipes 490 adjacent to each other among the plurality of refrigerant pipes 490. At least one h-shaped refrigerant pipe 411 may be disposed at the refrigerant flow channel 410. A refrigerant may be separated from the two-phase refrigerant through the refrigerant pipe 411. At this point, the separated refrigerant may consist mostly of a gas refrigerant and may include a small proportion of a liquid refrigerant. The refrigerant flow channels 430 and 450 may be applied in the same manner as the refrigerant flow channels 410.

Figure 5:
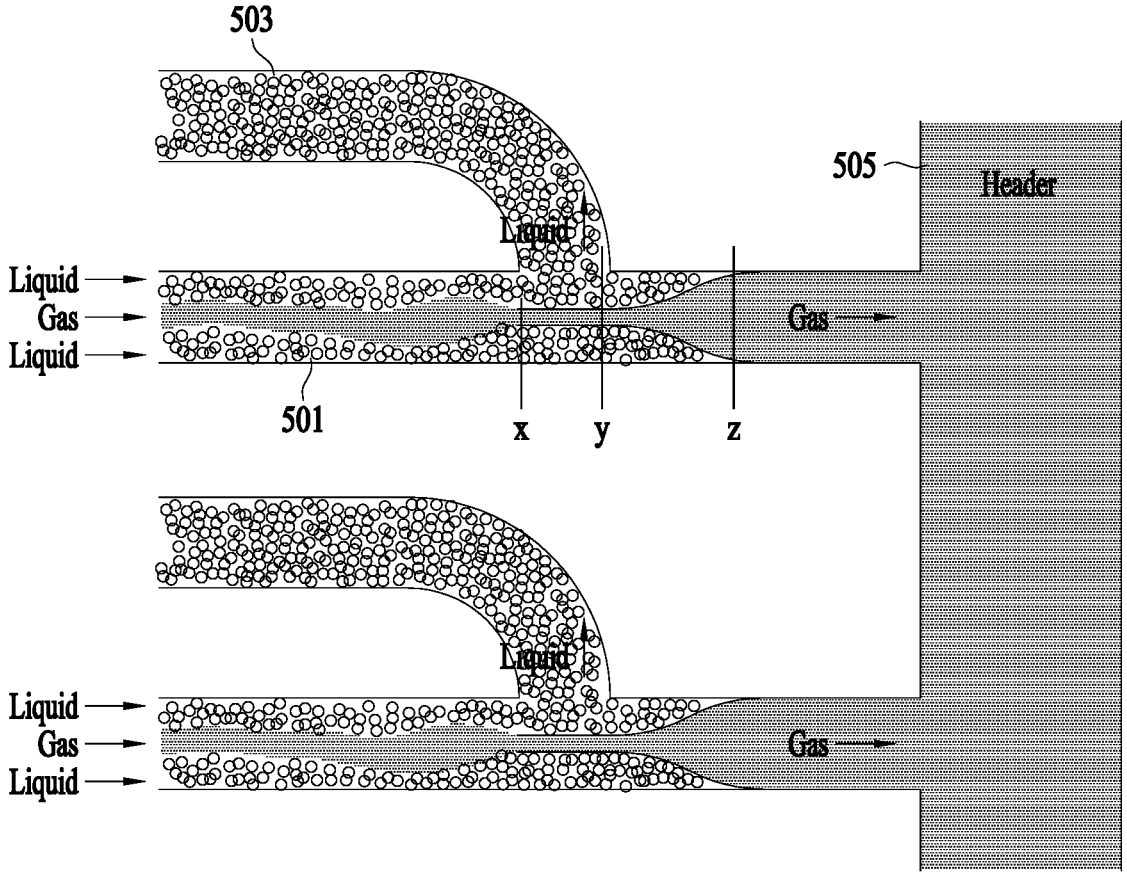
FIG. 5 is a diagram illustrating a flow pattern of a liquid refrigerant and a gas refrigerant according to an embodiment.

FIG. 5 is a diagram illustrating a flow pattern of a liquid refrigerant and a gas refrigerant according to an embodiment.

Referring to FIG. 5, a flow pattern of a two-phase refrigerant including a liquid refrigerant and a gas refrigerant may differ according to a dryness and a flow velocity. When a constant dryness and a constant flow velocity are ensured, the liquid refrigerant may flow along a wall surface of a refrigerant pipe and the gas refrigerant may flow inside the liquid refrigerant. As a result, the liquid refrigerant and the gas refrigerant may be separated. A flow pattern occurring when the liquid refrigerant and the gas refrigerant are separated and flow inside the refrigerant pipe may be referred to as an annular flow.

When the annular flow occurs, the liquid refrigerant may flow along the wall surface of a refrigerant pipe 501 and the gas refrigerant may flow inside the liquid refrigerant. In doing so, the gas refrigerant may be separated from the two-phase refrigerant flowing inside the evaporator and may flow to the connection pipes and the header. At this point, a small amount of the liquid refrigerant as well as the gas refrigerant may flow to the connection pipes and the header.

A refrigerant separated from the two-phase refrigerant flowing inside the evaporator may flow to the header 505 through the connection pipes, and a refrigerant not separated may flow to a refrigerant pipe 503.

Figure 6:
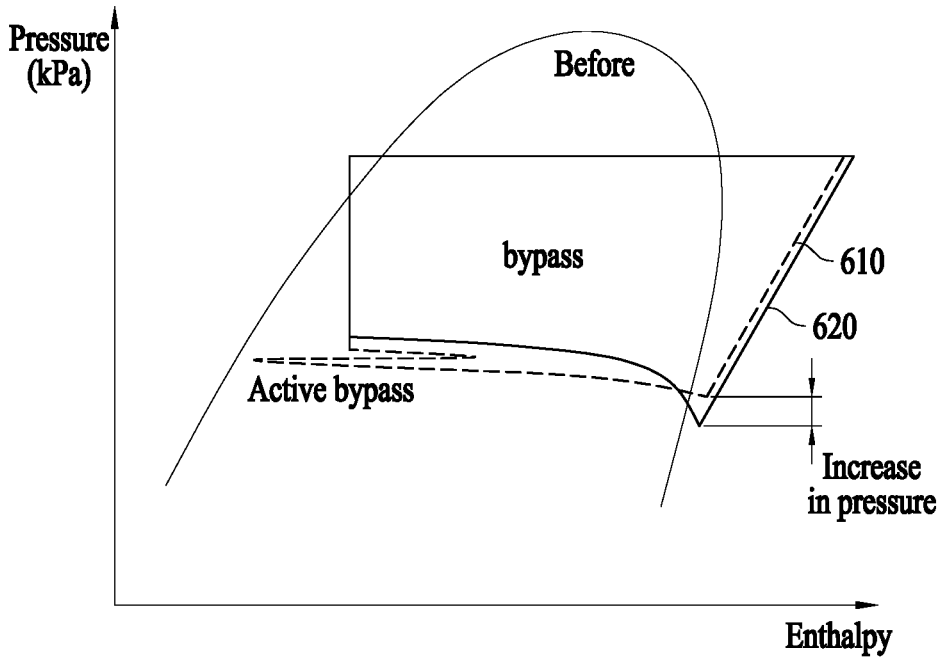
FIG. 6 is a diagram illustrating a P-H line according to an embodiment.

FIG. 6 is a diagram illustrating a P-H line according to an embodiment.

Referring to FIG. 6, a pressure-enthalpy change caused by a refrigerant flowing inside the air conditioner may be as shown in a graph 620. However, a pressure-enthalpy change caused by the second refrigerant separated by the gas-liquid separator and flowing through the bypass pipe may be as shown in a graph 610. That is, the second refrigerant separated by the gas-liquid separator and flowing through the bypass pipe is heated in a subcooler and thus does not contain liquid refrigerant. Therefore, pressure may increase from the graph 620 to the graph 610.

According to an embodiment of the present specification, one or more of the following effects are provided.

First, it is possible to prevent damage to a compressor and improve reliability of an air conditioner by controlling a degree of superheat of a separated refrigerant based on a flow pattern in an evaporator.

Second, if a degree of superheat of the separated refrigerant is controlled based on the flow pattern inside the evaporator, a larger amount of refrigerant are bypassed, thereby improving the performance of the air conditioner.

Third, as a refrigerant is separated based on a refrigerant flow velocity in the evaporator and a degree of superheat of the separated refrigerant is controlled using a temperature sensor and a subcooler, it is possible to prevent introduction of liquid refrigerant into the compressor more effectively, thereby improving reliability of the air conditioner.

Effects of the present disclosure are not limited to the effects mentioned above, and other effects not mentioned may be apparent to those skilled in the art from the description of the claims.

On the other hand, the present specification and drawings have been disclosed for preferred embodiments of the present disclosure, although specific terms have been used, they are merely used in a general sense to easily describe the technical content of the present disclosure and to help understand the disclosure. It is not intended to limit the scope of the disclosure. It is apparent to those skilled in the art to which the present disclosure pertains that other modifications based on the technical spirit of the present disclosure can be implemented in addition to the embodiments disclosed herein.

What is claimed is:

1. An air conditioner, comprising:

a compressor;

a first heat exchanger connected to the compressor and configured to operate as a condenser during a cooling operation and to operate as an evaporator during a heating operation;

a refrigerant pipe disposed inside the first heat exchanger and configured to carry a two-phase refrigerant;

a connection pipe connected to the refrigerant pipe;

a header connected to the connection pipe and configured to receive a refrigerant separated from the two-phase refrigerant in the refrigerant pipe;

a bypass pipe connected to the header and configured to guide the refrigerant to the compressor;

a flow rate control valve installed at the bypass pipe and configured to control a flow rate of the refrigerant;

a subcooler configured to superheat the refrigerant flowing through the bypass pipe; and a controller configured to control an opening degree of the flow rate control valve, wherein the controller is configured to control the opening degree of the flow rate control valve based on a comparison between a refrigerant flow velocity of the two-phase refrigerant in the refrigerant pipe and a reference flow velocity.

2. The air conditioner of claim 1, wherein the refrigerant flow velocity is determined based on at least one of an operation frequency of the compressor, a number of paths of an outdoor unit of the air conditioner, or an outside temperature.

3. The air conditioner of claim 2, wherein the first heat exchanger is disposed in the outdoor unit.

4. The air conditioner of claim 1, wherein the reference flow velocity is a flow velocity at which the two-phase refrigerant in the refrigerant pipe forms an annular flow.

5. The air conditioner of claim 1, further comprising:

a first temperature sensor configured to measure a first temperature of the refrigerant introduced into the subcooler; and a second temperature sensor configured to measure a second temperature of the refrigerant discharged from the subcooler.

6. The air conditioner of claim 5, wherein the controller is configured to control the opening degree of the flow rate control valve based on information obtained by the first temperature sensor and the second temperature sensor.

7. The air conditioner of claim 5, wherein the controller is configured to:

based on a difference between the first temperature and the second temperature being greater than or equal to a reference value, increase the opening degree of the flow rate control valve; and based on the difference between the first temperature and the second temperature being less than the reference value, decrease the opening degree of the flow rate control valve.

8. The air conditioner of claim 1, further comprising a second heat exchanger spaced apart from the first heat exchanger, wherein the subcooler is configured to exchange heat between the refrigerant guided through the bypass pipe and a refrigerant guided from the second heat exchanger to the first heat exchanger.

9. The air conditioner of claim 8, wherein the second heat exchanger is configured to operate as the evaporator during the cooling operation and to operate as the condenser during the heating operation.

10. The air conditioner of claim 8, wherein the second heat exchanger is disposed in an indoor unit of the air conditioner.

11. The air conditioner of claim 1, wherein the bypass pipe comprises a first portion between the header and the subcooler, and a second portion between the subcooler and the compressor, and wherein the flow rate control valve is installed at the first portion of the bypass pipe.

12. An air conditioner, comprising:

a compressor;

a condenser and an evaporator that are connected to the compressor;

a refrigerant pipe disposed inside the evaporator and configured to carry a two-phase refrigerant;

a connection pipe connected to the refrigerant pipe;

a header connected to the connection pipe and configured to receive a refrigerant separated from the two-phase refrigerant in the refrigerant pipe;

a bypass pipe connected to the header and configured to guide the refrigerant to the compressor;

a flow rate control valve installed at the bypass pipe and configured to control a flow rate of the refrigerant;

a subcooler disposed at the bypass pipe and configured to superheat the refrigerant flowing through the bypass pipe; and a controller configured to control the flow rate control valve, wherein the controller is configured to control the flow rate control valve based on a comparison between a refrigerant flow velocity of the two-phase refrigerant in the refrigerant pipe and a reference flow velocity.

13. The air conditioner of claim 12, wherein the bypass pipe comprises a first portion between the header and the subcooler, and a second portion between the subcooler and the compressor, and wherein the flow rate control valve is installed at the first portion of the bypass pipe.

14. The air conditioner of claim 13, further comprising:

a first valve disposed between the subcooler and the evaporator; and a second valve disposed between the condenser and the subcooler.

15. The air conditioner of claim 14, further comprising:

an accumulator disposed between the evaporator and the compressor and configured to separate a gas-phase refrigerant from the two-phase refrigerant such that the compressor receives a liquid-phase refrigerant.

16. The air conditioner of claim 15, wherein the compressor is configured to receive the liquid-phase refrigerant from the accumulator and the refrigerant from the bypass pipe.

17. An air conditioner, comprising:

a compressor;

a first heat exchanger connected to the compressor and configured to operate as a condenser during a cooling operation and to operate as an evaporator during a heating operation;

a refrigerant pipe disposed inside the first heat exchanger and configured to carry a two-phase refrigerant;

a connection pipe connected to the refrigerant pipe;

a header connected to the connection pipe and configured to receive a refrigerant separated from the two-phase refrigerant in the refrigerant pipe;

a bypass pipe connected to the header and configured to guide the refrigerant to the compressor;

a flow rate control valve installed at the bypass pipe and configured to control a flow rate of the refrigerant;

a subcooler configured to superheat the refrigerant flowing through the bypass pipe;

a first temperature sensor configured to measure a first temperature of the refrigerant introduced into the subcooler;

a second temperature sensor configured to measure a second temperature of the refrigerant discharged from the subcooler; and a controller configured to control an opening degree of the flow rate control valve, wherein the controller is configured to:

based on a difference between the first temperature and the second temperature being greater than or equal to a reference value, increase the opening degree of the flow rate control valve; and based on the difference between the first temperature and the second temperature being less than the reference value, decrease the opening degree of the flow rate control valve.

* * * * *